United States Patent [19]

Leister et al.

[11] 4,123,368

[45] Oct. 31, 1978

[54] ALKALINE EARTH METAL SALT DISPERSIONS IN ACRYLIC POLYMERS

[75] Inventors: Norman A. Leister, Huntington Valley; Andrew Neuman, Maple Glen, both of Pa.

[73] Assignee: Rohm and Haas Company, Philadelphia, Pa.

[21] Appl. No.: 780,931

[22] Filed: Mar. 24, 1977

[51] Int. Cl.[2] ..... C10M 1/10; C10M 3/02; C10M 5/02; C10M 7/02

[52] U.S. Cl. ..... 252/25; 252/56 R; 252/51.5 A; 252/389 R; 252/400 R

[58] Field of Search ..... 252/18, 25, 56 R, 51.5 A, 252/389 R, 400 R

[56] References Cited

U.S. PATENT DOCUMENTS

| | | | |
|---|---|---|---|
| 3,262,880 | 7/1966 | Voorhees | 252/25 |
| 3,313,727 | 4/1967 | Peeler | 252/25 |
| 3,451,931 | 6/1969 | Kahn et al. | 252/32.7 HC |
| 3,515,669 | 6/1970 | Le Suer | 252/39 |
| 3,567,637 | 3/1971 | Sabol | 252/39 |
| 3,783,131 | 1/1974 | Le Suer | 252/25 |
| 3,842,009 | 10/1974 | Barry et al. | 252/25 |
| 3,959,164 | 5/1976 | Sabol | 252/25 |
| 4,057,504 | 11/1977 | Shiga et al. | 252/25 |

*Primary Examiner*—Delbert E. Gantz
*Assistant Examiner*—Irving Vaughn
*Attorney, Agent, or Firm*—Lester E. Johnson

[57] ABSTRACT

This invention relates to colloidal dispersions of an alkaline earth metal salt in an oil-soluble acrylic polymer which is polymerized from a monomer system of at least one alkyl or hetero-substituted alkyl ester of an acrylic monomer selected from the group consisting of methacrylates and acrylates represented by the formula:

$$CH_2{=}C(R^1){-}\overset{\overset{\displaystyle O}{\|}}{C}{-}O{-}R^2 \qquad (I)$$

wherein $R^1$ is a $-CH_3$ or $-H$ radical, and $R^2$ is selected from the group consisting of $C_{1-30}$ alkyl and hetero-substituted alkyl radicals. This invention also relates to colloidal dispersions as described hereinabove wherein the monomer system further includes at least one non-acrylic polymerizable ethylenically unsaturated nitrogen-containing compound. Preferred polymerizable ethylenically unsaturated nitrogen-containing compounds are those selected from the group consisting of 2- and 4-vinylpyridines and N-vinyl-2-pyrrolidinones. Further, this invention relates to finished lubricating oil compositions wherein the metal salt-polymer dispersions are incorporated into lubricating oil compositions, either alone or in combination with other oil additives, whereby the metal salt-polymer colloidal dispersions impart improved properties to the finished lubricating oil compositions.

18 Claims, No Drawings

ALKALINE EARTH METAL SALT DISPERSIONS IN ACRYLIC POLYMERS

BACKGROUND OF THE INVENTION

This invention relates to colloidal dispersions of an alkaline earth metal salt in an oil-soluble acrylic polymer, which dispersions serve to improve the properties of lubricating oil compositions. This invention also relates to finished lubricating oil compositions having the metal salt-polymer dispersions of the invention incorporated therein, either alone or in combination with other oil additives, whereby the metal salt-polymer colloidal dispersions impart improved properties to the finished lubricating oil compositions.

Lubricating oil compositions for internal combustion engines and for automatic transmissions require a combination of additives in the oil base to supply various functions, in addition to lubricity, such as rust and corrosion inhibition, oxidative and thermal stability, dispersion of carbonaceous deposits and insoluble matter formed by fuel combustion and oil oxidation, neutralization of acidic materials formed by oil oxidation, and improved viscosity index.

It is known in the art to employ basic metal compounds dispersed in an oil additive composition in a lubricating oil composition to provide an alkaline reserve in the lubricating oil composition so as to neutralize acidic materials formed therein. The preparation of such dispersions is commonly referred to in the art as "overbasing," which term was originally derived as a description of the practice of incorporating an alkaline earth metal compound in an oil base in excess so as to satisfy the equivalency of any acidic materials produced by oxidation of oil and burning of petroleum distillate fuels. Examples of such known basic metal compounds are alkaline earth metal salts of organic sulfonic acids, alkyl phenols (phenates), alkyl thiophenols, sulfides, and carboxylic acids.

Although the metal sulfonates and phenates satisfactorily serve to neutralize acidic oil by-products and contribute to detergency and corrosion inhibition, they can themselves contribute to undesirable insoluble deposits once their function is exhausted. The use of carboxylic acid salts such as, for example, alkenyl substituted succinates, and of high molecular weight carboxylic acid esters in combination with metal salts of acidic gases such as, for example, $CO_2$, has provided some improvement in the art in that such compounds decompose upon exhaustion to give substantial amounts of volatile by-products, thereby leaving reduced amounts of insoluble deposits. The use of nitrogen-containing derivatives of high molecular weight carboxylic acids along with metal salts of acidic gases such as $CO_2$ has provided further improvement in the art in that the presence of the nitrogen-containing moiety contributes dispersancy to additives possessing detergency, rust and inhibiting, oxidative and thermal stabilizing, and acid-neutralizing properties. For example, overbased alkenyl succinic anhydride derivatives, including the class consisting of the reaction products of the anhydride with amino compounds and nitrogen-containing hydroxy compounds, are commonly used. Still further improvement in the art has been achieved by including in lubricant mixtures compounds which are characterized by excellent resistance to viscosity breakdown under shearing stress, i.e. viscosity index improver additives. High polymer compounds such as, for example, polyalkylmethacrylates, are a class of compounds which is particularly useful in lubricant formulations in that these compounds demonstrate especial viscosity index improver effects in addition to dispersancy, detergency, oxidative stabilization and compatibility with additives in lubricating oil compositions.

SUMMARY OF THE INVENTION

The object of this invention is to provide an improved multi-functional lubricating oil additive composition which imparts a combination of improved properties such as, for example, viscosity index, detergency, dispersancy, excess alkalinity for acid neutralization, oxidative and thermal stabilization, and corrosion and rust inhibition to finished lubricating oil compositions.

Another object of this invention is to provide an improved finished lubricating oil composition wherein the lubricating oil additive of the invention is blended in minor proportions with a lubricating oil composition, the major portion of which comprises a lubricating oil base, i.e. a stock neutral dilution oil used in lubricating oil compositions. The term "major" refers to amounts greater than 50% up to and including 100% by weight. The term "minor" refers to an amount less than 50% but greater than 0% by weight.

These objects, and others as will become apparent from the following description, are achieved by the present invention which comprises an improved overbased additive composition suitable for addition to a lubricating oil comprising a colloidal dispersion of (a) 1 part to 10 parts of an alkaline earth metal salt in (b) 99 parts to 90 parts of an oil-soluble acrylic polymer which is polymerized from a monomer system comprising at least one alkyl or hetero-substituted alkyl ester of an acrylic monomer selected from the group consisting of methacrylates and acrylates represented by the formula:

$$CH_2{=}C(R^1){-}\overset{\overset{\displaystyle O}{\|}}{C}{-}O{-}R^2 \qquad \text{(Formula I)}$$

wherein $R^1$ is a $-CH_3$ and $-H$ radical, and $R^2$ is a $C_{1-30}$ alkyl or hetero-substituted alkyl radical or a mixture thereof, said ester or mixture of esters having an $R^2$ radical containing a sufficient number of carbon atoms to render the polymer oil-soluble.

In another aspect, this invention comprises an overbased additive composition for a lubricating oil composition as set forth immediately above comprising additionally about 2% to 30% by weight of total monomer system of at least one non-acrylic polymerizable ethylenically unsaturated nitrogen-containing compound.

In yet another aspect, this invention comprises a finished lubricating oil composition comprising (a) 1 part to 15 parts of the overbased additive composition of this invention blended with (b) 99 parts to 85 parts of a lubricating oil composition, the major portion of which comprises a lubricating oil base, i.e. a stock neutral dilution oil. Here, the term "major" refers to an amount greater than 50% up to and including 100% by weight. The lubricating oil composition may further contain minor amounts (less than 50% but greater than 0%) of other additives or additive mixtures.

As stated hereinabove, the oil-soluble acrylic polymer used in this invention is polymerized from a monomer system comprising at least one alkyl or hetero-substituted alkyl ester of an acrylic monomer selected from the group consisting of methacrylates and acrylates represented by the formula:

$$CH_2{=}C(R^1){-}\overset{\overset{\displaystyle O}{\|}}{C}{-}O{-}R^2 \qquad \text{(Formula I)}$$

wherein $R^1$ is a $-CH_3$ or $-H$ radical, and $R^2$ is selected from the group $C_{1-30}$ alkyl and hetero-substituted alkyl radicals or a mixture thereof, said ester or mixture of esters having an $R^2$ radical containing a sufficient number of carbon atoms to render the polymer oil-soluble. A more preferred monomer system is that comprising at least one alkyl ester of methacrylic acid, represented by Formula I, wherein $R^1$ is $-CH_3$ and $R^2$ is selected from the group consisting of $C_{1-30}$ alkyl radicals or a mixture thereof, said ester or mixture of esters having an $R^2$ radical containing a sufficient number of carbon atoms to render the polymer oil-soluble. A most preferred monomer system is that comprising from 50% to 80% by weight of total monomer system of at least one alkyl ester of methacrylic acid, represented by Formula I, wherein $R^1$ is $-CH_3$ and $R^2$ is selected from the group consisting of $C_{10-20}$ alkyl radicals, the balance of said monomer system comprising one or more alkyl esters of methacrylic and acrylic acids, represented by Formula I, wherein $R^1$ is selected from the group consisting of $-CH_3$ and $-H$ radicals, respectively, and $R^2$ is selected from the group consisting of $C_{1-30}$ alkyl radicals. This most preferred monomer system may further include in said balance 0.5% to 10% by weight of total monomer system of hetero-substituted alkyl esters of methacrylic and acrylic acids, represented by Formula 1, wherein $R^1$ is selected from the group consisting of $-CH_3$ and $-H$, respectively, and $R^2$ is selected from the group consisting of di-alkylaminoalkyl radicals having the formula $-C_nH_{2n}NR^3R^4$ wherein n is 1 to 3 and $R^3$ and $R^4$ are, when taken individually, $-CH_3$ to $-C_4H_9$ or, when taken together, an alkylene chain of 4 to 5 atoms selected from the group consisting of $-C_4H_8-$, $-C_5H_{10}-$, and $-C_2H_4-O-C_2H_4-$ which jointly with the nitrogen atom forms a monoheterocyclic amine.

When the monomer systems described hereinabove, and the polymer prepared therefrom, further include about 2% to 30% by weight of total monomer system of at least one non-acrylic polymerizable ethylenically unsaturated nitrogen-containing compound, said nitrogen-containing compound is selected from the group consisting of N-alkenyl substituted compounds belonging to the classes including lactams, amides, imides, ureas, and oxazolidones; and of C-alkenyl substituted nitrogen-containing compounds belonging to the classes including tertiary aliphatic amines, heterocyclic aliphatic amines and heterocyclic aromatic amines. Preferred polymerizable ethylenically unsaturated nitrogen-containing compounds comprise the group consisting of N-vinylpyrrolidinone and lower alkyl substituted derivatives thereof and 2- and 4-vinylpyridine and lower alkyl substituted derivatives thereof. Most preferred non-acrylic polymerizable ethylenically unsaturated nitrogen-containing compounds comprise the group consisting of N-vinylpyrrolidinone and lower alkyl substituted derivatives thereof, especially used in the amount of 2% to 15% by weight of total monomer system.

Another preferred monomer system is that comprising $C_{1-30}$ alkyl and hetero-substituted alkyl esters of methacrylic and acrylic acids, as described hereinabove, further including 2% to 30% by weight of total monomer system of at least one non-acrylic polymerizable ethylenically unsaturated nitrogen-containing compound selected from the group consisting of N-vinylpyrrolidinone and lower alkyl substituted derivatives thereof and of 2- and 4-vinylpyridine and lower alkyl substituted derivatives thereof. Another more preferred monomer system is that comprising at least one $C_{1-30}$ alkyl methacrylate ester, as described hereinabove, further including 2% to 30%, and preferably 2% to 15%, by weight of total monomer system of at least one compound selected from the group consisting of N-vinylpyrrolidinone and lower alkyl substituted derivatives thereof. Another most preferred monomer system is that comprising from 50% to 80% by weight of total monomer system of at least one alkyl ester of methacrylic acid, represented by Formula I, wherein $R^1$ is $-CH_3$ and $R^2$ is selected from the group consisting of $C_{10-20}$ alkyl radicals, the balance of said monomer system comprising one or more alkyl esters of methacrylic and acrylic acids, represented by Formula I, wherein $R^1$ is selected from the group consisting of $-CH_3$ and $-H$ radicals and $R^2$ is selected from the group consisting of $C_{1-30}$ alkyl radicals, said balance further including 2% to 15% of at least one compound selected from the group consisting of N-vinylpyrrolidinone and lower alkyl substituted derivatives thereof. Still another most preferred monomer system is that comprising 50% to 80% by weight of total monomer system of at least one $C_{10-20}$ alkyl methacrylate, the balance of said monomer system comprising one or more $C_{1-30}$ alkyl esters of methacrylic and acrylic acids, further including 0.5% to 10% of di-alkylaminoalkyl esters of methacrylic and acrylic acids wherein the di-alkylaminoalkyl radical is as described hereinabove, and still further including 2% to 15% of at least one compound selected from the group consisting of N-vinylpyrrolidinone and lower alkyl substituted derivatives thereof.

The metal salts used in this invention are alkaline earth metal salts principally of acidic gases of the group consisting of carbon dioxide, sulfur dioxide, sulfur trioxide, hydrogen chloride, nitrogen dioxide, hydrogen sulfide, and the like. Preferred gases are carbon dioxide, sulfur dioxide, and $H_2S$. Carbon dioxide ($CO_2$) is the most preferred gaseous material. Preferred metal compounds from which the salts used in this invention are derived include the oxides and hydroxides of barium, calcium, and magnesium. Most preferred metal compounds are those of calcium (CaO and $Ca(OH_2)$ which, when reacted with carbon dioxide, give calcium carbonate. Preferably, the metal salt comprises from 1% to 10% of the metal salt-polymer colloidal dispersion additive of the invention.

The overbased metal salt-polymer colloidal dispersion additive of this invention may be prepared by dissolving the metal compound, for example, calcium oxide, in a solvent system which comprises, for example, a mixture of anhydrous methanol, isobutanol and xylene in a reaction vessel. This charge is mixed thoroughly by means of mechanical stirring and warmed to 30°-35° C.; then gaseous carbon dioxide is passed into the vigorously stirred charge for a period of 0.5 to 2.0 hours, allowing for the CaO and $CO_2$ to react to form $CaCO_3$. After this carbonation period, the $CaCO_3$ saturated charge is transferred to another vessel suited for reduced pressure distillation and the volatile solvent is removed by distillation at a pressure of 30 to 100 mm Hg and at a temperature of 45°-65° C. Then, a solution of the desired copolymer in a suitable solvent such as, for example, xylene is blended with the $CaCO_3$ charge. A small amount of dilution oil may be added to the copolymer solvent if desired. This mixture is then stirred and heated to 100° C. under reduced pressure to ensure that all the solvent is removed. After cooling this mixture to 85°–90° C., water is added to the vigorously stirred mixture in order to effect the dispersion of $CaCO_3$ in the copolymer medium.

The finished lubricating oil composition of this invention is prepared by blending the overbased metal salt-polymer colloidal dispersion additive described hereinabove into an amount greater than 50% up to and including 100% of a lubricating oil base selected from the group consisting of mineral lubricating oils and synthetic oils. The mineral lubricating oils include refined petroleum oils as well as those derived from paraffinic, naphthenic, asphaltic, and mixed base crude oils. The synthetic oils include hydrocarbons, halogenated hydrocarbons, dibasic acid esters, carbonate esters, polysilicones, phosphate esters, polyglycols, and glycol esters. Preferred oils of this invention are refined neutral petroleum oils; these oils are alternatively commonly referred to as petroleum distillate oils.

The metal salt-polymer colloidal dispersion additives of this invention may be used as the sole additive in lubricating oil compositions or they may be used in combination with other additives such as additional dispersants, anti-oxidants, detergents, and corrosion inhibitors. These other additives may be dissolved in the lubricating oil first and then the metal salt-polymer additive blended into the lubricant solution or vice versa.

In contrast to the clear polymeric substrates, the dispersions of the invention are quite turbid and appear as suspect for ready separation or settling of solids. However, centrifugation of the neat over-based materials of this invention at 16,000 rpm for periods of one to two hours fails to effect precipitation.

The following examples are only illustrative of the present invention and are not to be construed as limiting in scope. All parts and percentages throughout the specification and claims are by weight unless otherwise indicated. Substrate polymers used in the following examples are as follows:

Substrate A is polymerized from a monomer system of stearyl methacrylate, dodecyl-pentadecyl methacrylate mixture, butyl methacrylate and N-vinylpyrrolidone as described in U.S. Pat. No. 3,142,664. Substrate B is polymerized from a monomer system of cetyl-stearyl methacrylate mixture, dodecyl-pentadecyl methacrylate mixture, butyl methacrylate and N-vinylpyrrolidone by the method described in U.S. Pat. No. 3,506,574. Substrate C is polymerized from a monomer system of cetyl-stearyl methacrylate mixture, dodecyl-pentadecyl methacrylate mixture, and butyl methacrylate by the method used to prepare the acrylic base polymer of Substrate B as described in U.S. Pat. No. 3,506,574. All three substrates have compositions optimized to impart good low temperature flow properties to finished lubricating oil compositions. Substrate D is polymerized from a monomer system of dodecyl-pentadecyl methacrylate mixture and methacrylic acid in the weight ratio of 97:3.

EXAMPLE 1

An overbased metal salt-dispersant polymer colloidal dispersion additive according to this invention is prepared as follows. A reaction vessel equipped with an efficient stirrer, gas inlet dip-pipe, and a reflux condenser is charged with 140 parts anhydrous methanol, 21.6 parts calcium oxide, and 178 parts xylene with continuous stirring. The charge is mixed thoroughly and warmed to 33° C.; then gaseous carbon dioxide is passed into the vigorously stirred batch at a rate of 250 ml/min for a period of one hour. During this period, the temperature increases adiabatically to a maximum of 46° C. after 30 minutes and thereafter declines. At the end of the carbonation step, the resulting mix is transferred to a distillation vessel and the methanol solvent is distilled-off under a reduced pressure of about 50 mm Hg and at a temperature of about 55° C. To the resulting stirred residue is added 240 parts nitrogen-containing polymethacrylate copolymer substrate A, 240 parts dilution oil and 150 parts xylene. The resulting stirred mixture is first heated to 100° C. pot temperature (80° C. vapor temperature) to ensure the removal of excess methanol then cooled to 85°–90° C. and treated with 61% of the stoichiometric amount of water required for the conversion, $CaO \xrightarrow{H_2O} Ca(OH)_2$, in order to effect the dispersion of $CaCO_3$. Then, the stirred mixture is heated to 160° pot temperature (vapor temperature 140° C.) to ensure removal of water, the residue is then centrifuged and the decanted liquor heated under reduced pressure to distill off all volatile materials, thereby yielding a hazy product. The overbased detergent-viscosity index improver additive thus obtained has a TBN (total base number) - 16.6 which is equivalent to 1.48 weight % $CaCO_3$.

The TBN is determined by a method which involves the titration of calcium cation ($Ca^{++}$) in a non-aqueous system with perchloric acid according to modifications of procedures reported in Anal. Chem., 23 (2) 337 (1951); ibid 24 (3), 519 (1952).

EXAMPLE 2

An overbased metal salt-dispersant polymer colloidal dispersion is prepared as in Example 1 except that the water treatment step involves the addition of 107% of the stoichiometric amount of water. The additive thereby obtained has a TBN = 29.1, which is equivalent to 2.59 weight % $CaCO_3$.

EXAMPLE 3

An overbased metal salt-dispersant polymer colloidal dispersion additive according to this invention is prepared as in Example 1 except that the $CaCO_3$ is derived from $Ca(OH)_2$ rather than from CaO and that the process employed yields a product having an increased weight % of $CaCO_3$. A reaction vessel equipped as in Example 1 is charged with 140 parts anhydrous methanol, 28.6 parts calcium hydroxide ($Ca(OH)_2$, 94% pure), and 178 parts isobutanol with continuous stirring. After mixing thoroughly and warming and maintaining the temperature at 30° C., carbon dioxide gas is passed into the vigorously stirred mixture at a rate of 250 m./min. for a total of 0.536 moles. The resulting carbonated slurry is then continuously transferred over a period of 30–35 min. to a distillation vessel containing 600 parts of nitrogen-containing polymethacrylate copolymer substrate A and 300 parts xylene; simultaneously methanol and isobutanol are distilled-off under reduced pressure of about 250 mm Hg and at a pot temperature of 75°–80° C. (vapor temperature about 80° C.). Then, after venting the system to ambient pressure, 48 parts water is added, in six equal portions, to the stirred mixture in order to effect the dispersion of $CaCO_3$, distilling water and solvent after each water addition. The residue is then centrifuged at 16,000 rpm for 1 hour and the decanted liquor is heated under reduced pressure so as to remove all volatile materials. The resulting opaque viscous product has a TBN = 39.8, which is equivalent to 3.55 weight % $CaCO_3$.

EXAMPLE 4

A lubricating oil composition (full blend) according to this invention is prepared by blending 1.5 parts neutral sulfonate, 1.3 parts anti-oxidant, 1.5 parts dispersant, 6.75 parts additive of Example 3; and the balance (88.95 parts) neutral dilution oil. The resulting composition has a TBN = 2.7, which is equivalent to 0.24 weight % $CaCO_3$.

EXAMPLE 5

An overbased metal salt dispersant polymer colloidal dispersion additive according to this invention is prepared as in Example 3 except that 0.670 moles of carbon dioxide gas is passed into the reaction vessel under adiabatic conditions. The resulting carbonated slurry is then combined with 600 parts nitrogen-containing polymethacrylate copolymer substrate B and 300 parts xylene as in Example 3. Dispersion of the $CaCO_3$ is effected by adding 32 parts of water in four equal portions. After further treatment as in Example 3, the resulting opaque viscous product has a TBN - 31.9, which is equivalent to 2.84 wt. % of $CaCO_3$.

EXAMPLE 6

An overbased metal salt dispersant polymer colloidal dispersion additive according to this invention is prepared as follows: A reaction vessel equipped as in Example 1 is charged with 140 parts anhydrous methanol, 28.6 parts calcium hydroxide ($Ca(OH)_2$, 94% pure), and 178 parts isobutanol with continuous stirring. After mixing thoroughly and warming and maintaining the charge at 30° C., carbon dioxide gas is passed into the vigorously stirred mixture at a rate of 250 ml/min. for a period of 1 hour. The resulting carbonated slurry is then continuously transferred over a period of 30–35 min. to a distillation vessel containing 600 parts nitrogen-containing polymethacrylate copolymer substrate B and 300 parts xylene; simultaneously, methanol and isobutanol are distilled-off under reduced pressure of about 250 mm Hg and a pot temperature of 75°–80° C. (vapor temperature about 80° C.). Then, after venting the system to ambient pressure, 48 parts of water is added in four equal portions, to the stirred mixture in order to effect dispersion of $CaCO_3$, distilling water and solvent after each addition. The residue is then centrifuged at 16,000 rpm for 1 hour and the decanted liquor is heated under reduced pressure so as to remove all volatile materials. The opaque viscous product thereby obtained has a TNB = 41.3, which is equivalent to 3.68 weight % $CaCO_3$.

EXAMPLE 7

A lubricating oil composition (full blend) according to this invention is prepared by blending 1.5 parts neutral sulfonate (Bryton C-45), 1.3 parts antioxidant (OLOA 267), 1.5 parts dispersant (OLOA 1200), 7.3 parts additive of Example 6 and the balance (88.4 parts) neutral dilution oil. The resulting composition has a TBN = 3.0, which is equivalent to 0.28 weight % $CaCO_3$.

EXAMPLE 8

An overbased metal salt non-dispersant polymer colloidal dispersion additive according to this invention is prepared in the following manner. A reaction vessel equipped as in Example 1 is charged with 140 parts anhydrous methanol, 28.6 parts calcium hydroxide ($Ca(OH)_2$, 94% pure), and 178 parts isobutanol with continuous stirring. After mixing thoroughly and warming and maintaining the temperature at 30° C., carbon dioxide gas is passed into the vigorously stirred mixture at a rate of 250 ml/min. for a period of 1 hour. The resulting carbonated slurry is continuously transferred into a distillation vessel containing 600 parts of nitrogen-free polymethacrylate copolymer substrate C and 300 parts of xylene; simultaneously methanol and isobutanol are distilled-off under reduced pressure of about 250 mm Hg and at a pot temperature of 75°–80° C. (vapor temperature about 80° C.). Then, after venting the system to ambient pressure, 43 parts water is added, in eight portions, to the stirred mixture in order to effect the dispersion of $CaCO_3$, distilling water and solvent after each water addition. The residue is then centrifuged at 16,000 rpm for 1 hour and the decanted liquor is heated under reduced pressure so as to remove all volatile materials. The resulting (opaque) viscous product has a TBN = 16.8, which is equivalent to 1.49 weight % $CaCO_3$.

EXAMPLE 9

A lubricating oil composition (full blend) according to this invention is prepared by blending 1.5 parts neutral sulfonate, 1.3 parts anti-oxidant, 1.5 parts dispersant, 6.80 parts non-dispersant additive of Example 8, and the balance (88.90 parts) neutral dilution oil. The resulting composition has a TBN = 1.1, which is equivalent to 0.22 weight % $CaCO_3$.

EXAMPLE 10

A comparison overbased metal salt non-dispersant polymer colloidal dispersion in the following manner. A reaction vessel, equipped as in Example 1, is charged with 100 parts nitrogen-free, methacrylic acid containing polymethacrylate copolymer D 200 parts neutral dilution oil, 128 parts xylene, 86 parts isobutanol, 3.4 parts water, 10 parts triethylamine, and 12 parts calcium hydroxide with continuous stirring. Triethylamine is added to counteract a strong hydrogen-bonding effect. Carbon dioxide gas is then passed into the vigorously stirred mixture at a rate of 37 ml/min. for 1 hour while maintaining the temperature of the charge at 70°–72° C. At the end of the carbonation period, the mixture is heated to a pot temperature of 160° C. (vapor temperature about 130° C.) at ambient pressure to distill-off all water, isobutanol, and triethylamine. The residue is diluted with 309 parts neutral dilution oil in order to improve its fluidity, the resulting mixture is centrifuged at 16,000 rpm for one hour and the decanted liquor is heated under reduced pressure to remove all volatile materials, thereby yielding in opaque, viscous product. The product thus obtained has a TBN = 16.2, which is equivalent to 1.4% $CaCO_3$.

EXAMPLE 11

An overbased metal salt-dispersant polymer colloidal dispersion according to the invention may be prepared as in Example 3 except that $Ba(OH)_2$ may be substituted for $Ca(OH)_2$ to give a product containing $BaCO_3$ rather than $CaCO_3$. A reaction vessel equipped as in Example 1 may be charged with 140 parts anhydrous methanol, 28.6 parts barium hydroxide ($Ba(OH)_2$) and 178 parts isobutanol with continuous stirring. After mixing thoroughly and warming and maintaining the temperature at 30° C., carbon dioxide gas may be passed into the vigorously stirred mixture at a rate of 250 ml/min. for a total of 0.536 moles. The resulting carbonated slurry may then be continuously transferred over a period of 30–35 min. to a distillation vessel containing 600 parts of nitrogen-containing polymethacrylate copolymer substrate A, which copolymer is described in Table 1, and 300 parts xylene; simultaneously methanol and isobutanol may be distilled off under reduced pressure of about 250 mm Hg and at a pot temperature of 75°–80° C. (vapor temperature about 80° C.). Then, after venting the system to ambient pressure, 48 parts water may be added, in six equal portions, to the stirred mixture in order to effect the dispersion of $BaCO_3$, distilling water and solvent after each water addition. The residue may then be centrifuged at 16,000 rpm for 1 hour and the decanted liquor heated under reduced pressure so as to remove all volatile materials.

EXAMPLE 12

An overbased metal salt-dispersant polymer colloidal dispersion according to the invention may be prepared as in Example 3 except that $Mg(OH)_2$ may be substituted for $Ca(OH)_2$ to give a product containing $MgCO_3$ rather than $CaCO_3$. A reaction vessel equipped as in Example 1 may be charged with 140 parts anhydrous methanol, 28.6 parts magnesium hydroxide ($Mg(OH)_2$) and 178 parts isobutanol with continuous stirring. After mixing thoroughly and warming and maintaining the temperature at 30° C., carbon dioxide gas may be passed into the vigorously stirred mixture at a rate of 250 ml/min. for a total of 0.536 moles. The resulting carbonated slurry may then be continuously transferred over a period of 30–35 min. to a distillation vessel containing 600 parts of nitrogen-containing polymethacrylate copolymer substrate A, which copolymer is described in Table 1, and 300 parts xylene; simultaneously methanol and isobutanol may be distilled off under reduced pressure of about 250 mm Hg and at a pot temperature of 75°–80° C. (vapor temperature about 80° C.). Then, after venting the system to ambient pressure, 48 parts water may be added, in six equal portions, to the stirred mixture in order to effect the dispersion of $CaCO_3$, distilling water and solvent after each water addition. The residue may then be centrifuged at 16,000 rpm for 1 hour and the decanted liquor heated under reduced pressure so as to remove all volatile materials.

The data presented in the following table, Table I, shows the advantages of the present invention wherein it is observed that the viscosity of the polymer remains virtually unchanged upon overbasing, i.e. treating to obtain a metal salt — polymer colloidal dispersion according to the invention. Further, it is observed that a relatively high amount of alkaline reserve — the amount of basic metal salt available to neutralize acid materials formed in oil by oil oxidation and to provide detergency — is achieved in this invention in comparison with the equivalent weight percent of alkaline reserve obtained in a comparative commercial calcium alkylarylsulfonate overbased blend. When $CaCO_3$ overbased dispersant polymer Example 3 (i.e. a polymer prepared from a monomer mix including a polymerizable nitrogen-containing compound) is compared with the same polymer which is free of $CaCO_3$ (control) in experiment A, it is observed that virtually the same amount of each additive provides oil blends having no significant difference in viscosity. Further, the oil blend containing $CaCO_3$ overbased dispersant polymer Example 3 provides an amount of alkaline reserve which does not differ significantly with the amount of alkaline reserve provided by an oil blend containing the same amount of a commercially available calcium alkylarylsulfonate additive. Similar results are obtained in experiment B which differs from experiment A only in that a different dispersant polymer is used. When $CaCO_3$ overbased non-dispersant polymer Example 8 (i.e. a polymer prepared from a monomer mix which does not include a polymerizable nitrogen-containing compound) is compared with the same polymer which is free of $CaCO_3$ (control) in experiment C, it is observed that the same amount of each additive provides oil blends having no significant difference in viscosity. However, the oil blend containing $CaCO_3$ overbased non-dispersant polymer provides an amount of alkaline reserve which is about one half of the amount of alkaline reserve provided by an oil blend containing the same amount of commercially available calcium alkylarylsulfonate additive.

TABLE I

Comparison of Viscosity of Polymers Before and After Overbasing

| | A | | B | | C | |
|---|---|---|---|---|---|---|
| Substrate Polymer | Control | Ex. 3 | Control | Ex. 6 | Control | Ex. 8 |
| Dispersant Polymer | Yes | Yes | Yes | Yes | No | No |
| Wt. % $CaCO_3$ Incorporated | 0 | 3.56 | 0 | 3.67 | 0 | 1.50 |
| Wt. % of Sample in 170 N. Oil for 210° F. Viscosity of 11 c St. | 6.5 | 6.75 | 7.04 | 7.30 | 6.70 | 6.79 |
| Alkaline Reserve in Blend, equivalent wt. % of commercial overbased calcium alkylarylsulfonate | 0 | 0.90 | 0 | 0.94 | 0 | 0.38 |
| Viscosity: (VI:ASTM-D 2270) | | | | | | |
| 210° F., c St. | 11.57 | 11.68 | 11.16 | 11.55 | 11.03 | 11.40 |
| 100° F., c St. | 66.31 | 68.55 | 67.68 | 69.85 | 68.22 | 68.32 |

What is claimed is:

1. An overbased additive composition suitable for addition to a lubricating oil comprising a colloidal dispersion of (a) 1 part to 10 parts of an alkaline earth metal salt comprising the reaction product of metal compounds selected from the group consisting of barium, magnesium and calcium oxides and hydroxides with acidic gases selected from the group consisting of carbon dioxide, sulfur dioxide, sulfur trioxide, hydrogen chloride, nitrogen dioxide, and hydrogen sulfide in (b) 99 parts to 90 parts of an oil-soluble acrylic polymer which is polymerized from a monomer system of at least one alkyl or hetero-substituted alkyl ester of an acrylic monomer selected from the group consisting of methacrylates and acrylates represented by the formula $$CH_2{=}C(R^1){-}\overset{\overset{\displaystyle O}{\|}}{C}{-}O{-}R^2$$

wherein $R^1$ is a $-CH_3$ or $-H$ radical and $R^2$ is a $C_{1-30}$ alkyl, or hetero-substituted alkyl, radical or a mixture thereof, said ester or mixture of esters having an $R^2$ radical containing a sufficient number of carbon atoms to render the polymer oil-soluble.

2. The overbased additive composition of claim 1 wherein said alkaline earth metal salt is calcium carbonate, the reaction product of calcium oxide or calcium hydroxide with carbon dioxide.

3. The overbased additive composition of claim 2 wherein said polymer is polymerized from said monomer system further including about 2% to 30% by weight of total monomer system of at least one non-acrylic polymerizable ethylenically unsaturated nitrogen-containing compound selected from the group consisting of N-alkenyl substituted compounds belonging to the classes including lactams, amides, imides, ureas, and oxazolidones; and of C-alkenyl substituted nitrogen-containing compounds belonging to the classes including tertiary aliphatic amines, heterocyclic aliphatic amines and heterocyclic aromatic amines.

4. The overbased additive composition of claim 3 wherein said polymerizable ethylenically unsaturated nitrogen-containing compound is selected from the group consisting of N-vinylpyrolidinone and lower alkyl substituted derivatives thereof and 2- and 4-vinyl pyridine and lower alkyl substituted derivatives thereof.

5. The overbased additive composition of claim 4 wherein said polymerizable ethylenically unsaturated nitrogen-containing compound is selected from the group consisting of N-vinylpyrrolidinone and lower alkyl substituted derivatives thereof.

6. The overbased additive composition of claim 2 comprising a colloidal dispersion of (a) 1 part to 10 parts of calcium carbonate in (b) 99 parts to 90 parts of an oil-soluble acrylic polymer which is polymerized from a monomer system comprising at least one alkyl ester of methacrylic acid, represented by the formula $$CH_2{=}C(R^1){-}\overset{\overset{\displaystyle O}{\|}}{C}{-}O{-}R^2$$

wherein $R^1$ is $-CH_3$ and $R^2$ is selected from the group consisting of $C_{1-30}$ alkyl radicals or a mixture thereof, said ester or mixture of esters having an $R^2$ radical containing a sufficient number of carbon atoms to render the polymer oil-soluble.

7. The overbased additive composition of claim 6 wherein said polymer is polymerized from said monomer system comprising from 50% to 80% by weight of total monomer system of at least one alkyl ester of methacrylic acid wherein $R^1$ is $-CH_3$ and $R^2$ is selected from the group consisting of $C_{10-20}$ alkyl radicals, the balance of said monomer system comprising one or more alkyl esters of methacrylic and acrylic acids, represented by the formula $$CH_2{=}C(R^1){-}\overset{\overset{\displaystyle O}{\|}}{C}{-}O{-}R^2$$

wherein $R^1$ is selected from the group consisting of $-CH_3$ and $-H$ radicals, respectively, and $R^2$ is selected from the group consisting of $C_{1-30}$ alkyl radicals.

8. The overbased additive composition of claim 7 wherein said polymer is polymerized from said monomer system, the balance of which further includes 0.5% to 10% by weight of total monomer system of hetero-substituted alkyl esters of methacrylic and acrylic acids, represented by the formula $$CH_2{=}C(R^1){-}\overset{\overset{\displaystyle O}{\|}}{C}{-}O{-}R^2$$

wherein $R^1$ is selected from the group consisting of $-CH_3$ and $-H$ radicals, respectively, and $R^2$ is selected from the group consisting of dialkylaminoalkyl radicals having the formula $-C_nH_{2n}NR^3R^4$ wherein $n$ is 1 to 3 and $R^3$ and $R^4$ are, when taken individually, $-CH_3$ to $-C_4H_9$ or, when taken together, an alkylene chain of 4 to 5 atoms selected from the group consisting of $-C_4H_8-$, $-C_5H_{10}$, and $-C_2H_4-O-C_2H_4-$ which jointly with the nitrogen atoms forms a monoheterocyclic amine.

9. The overbased additive composition of claim 7 wherein said polymer is polymerized from said monomer system further including 2% to 15% by weight of total monomer system of at least one compound selected from the group consisting of N-vinylpyrrolidinone and lower alkyl substituted derivatives thereof.

10. The overbased additive composition of claim 8 wherein said polymer is polymerized from said monomer system further including 2% to 15% by weight of total monomer system of at least one compound selected from the group consisting of N-vinylpyrrolidinone and lower alkyl substituted derivatives thereof.

11. A finished lubricating oil composition comprising (a) 1 part to 15 parts of the overbased additive of claim 1 blended with (b) 99 parts to 85 parts of a lubricating oil composition which comprises greater than 50% up to and including 100% by weight of a lubricating oil base selected from the group consisting of mineral lubricating oils including petroleum distillate oils and oils derived from paraffinic, naphthenic, asphaltic, and mixed base crude oils, and of synthetic oils including hydrocarbons, halogenated hydrocarbons, dibasic acid esters, carbonate esters, poly silicones, phosphate esters, poly glycols, and glycol esters.

12. A finished lubricating oil composition comprising (a) 1 part to 15 parts of the overbased additive of claim 2 blended with (b) 99 parts to 85 parts of a lubricating oil composition which comprises greater than 50% up to, and including, 100% by weight of a lubricating oil base comprising petroleum distillate oils.

13. A finished lubricating oil composition comprising (a) 1 part to 15 parts of the overbased additive composition of claim 3 blended with (b) 99 parts to 85 parts of a lubricating oil composition which comprises greater than 50% up to, and including, 100% by weight of a lubricating oil base comprising petroleum distillate oils.

14. A finished lubricating oil composition comprising (a) 1 part to 15 parts of the overbased additive composition of claim 6 blended with (b) 99 parts to 85 parts of a lubricating oil composition which comprises greater than 50% up to, and including, 100% by weight of a lubricating oil base comprising petroleum distillate oils.

15. A finished lubricating oil composition comprising (a) 1 part to 15 parts of the overbased additive composition of claim 7 blended with (b) 99 parts to 85 parts of a lubricating oil composition which comprises greater than 50% up to, and including, 100% by weight of a lubricating oil base comprising petroleum distillate oils.

16. A finished lubricating oil composition comprising (a) 1 part to 15 parts of the overbased additive composition of claim 8 blended with (b) 99 parts to 85 parts of a lubricating oil composition which comprises greater than 50% up to and including 100% by weight of a lubricating oil base comprising petroleum distillate oils.

17. A finished lubricating oil composition comprising (a) 1 part to 15 parts of the overbased additive composition of claim 9 blended with (b) 99 parts to 85 parts of a lubricating oil composition which comprises greater than 50% up to, and including, 100% by weight of a lubricating oil base comprising petroleum distillate oils.

18. A finished lubricating oil composition comprising (a) 1 part to 15 parts of the overbased additive composition of claim 10 blended with (b) 99 parts to 85 parts of a lubricating oil composition which comprises greater than 50% up to, and including, 100% by weight of a lubricating oil base comprising petroleum distillate oils.

* * * * *